United States Patent [19]

Lustvee

[11] Patent Number: 5,002,260

[45] Date of Patent: Mar. 26, 1991

[54] FENCE

[76] Inventor: Kaljo Lustvee, 18 Finchley Road, Islington, Ontario, Canada, M9A 2X5

[21] Appl. No.: 389,089

[22] Filed: Aug. 3, 1989

[51] Int. Cl.[5] ..... E04H 17/14

[52] U.S. Cl. ..... 256/22; 256/59; 256/65; 256/70; 256/72

[58] Field of Search ..... 256/65, 59, 70, 22, 256/72

[56] References Cited

U.S. PATENT DOCUMENTS

| | | | |
|---|---|---|---|
| 262,879 | 8/1882 | Woodhill | 256/72 |
| 292,023 | 1/1884 | Manlove | 256/65 |
| 448,029 | 3/1891 | Hanika | 256/65 |
| 485,268 | 11/1892 | Flynn | 256/72 |
| 502,840 | 8/1893 | Ward | 256/65 |
| 743,046 | 11/1903 | Stewart et al. | 256/72 |
| 1,611,737 | 12/1926 | Coruss | 256/72 |
| 1,757,686 | 5/1930 | Rosenbaum | 256/72 X |
| 2,976,021 | 3/1961 | Stefan | 256/65 |
| 3,286,850 | 11/1966 | Ruhnke | 256/65 X |
| 3,700,213 | 10/1972 | Blease | 256/59 X |

*Primary Examiner*—Randolph A. Reese
*Assistant Examiner*—Carol I. Bordas
*Attorney, Agent, or Firm*—Rogers, Bereskin & Parr

[57] ABSTRACT

A fence construction includes a first transverse rail having a plurality of first mounting locations, each for mounting one of a plurality of pickets. Each mounting location of the rail has vertically and horizontally spaced opposing first and second surfaces, and each picket is provided with corresponding oppositely directed first and second surfaces, an downwardly directed first surface for engaging a respective first surface of a mounting location and a second surface for engaging a respective second surface of the mounting location. The diameter of each picket is selected to be less than the spacing of the respective first and second surfaces of the mounting location to allow an inclined picket to pass therebetween and thus be located on the rail. A second transverse rail is provided for retaining the pickets in a substantially upright orientation and for retaining the first and second surfaces of each picket in engagement with the respective first and second surfaces of the mounting location.

20 Claims, 2 Drawing Sheets

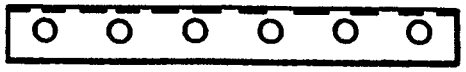
FIG. 1
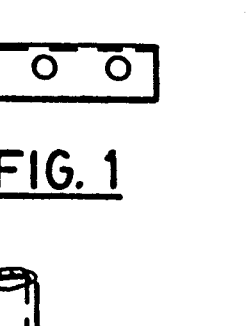
FIG. 2
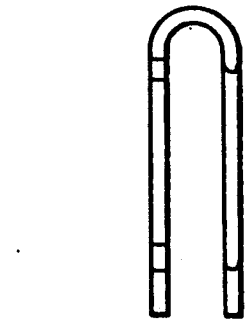
FIG. 3
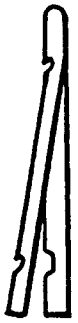
FIG. 4
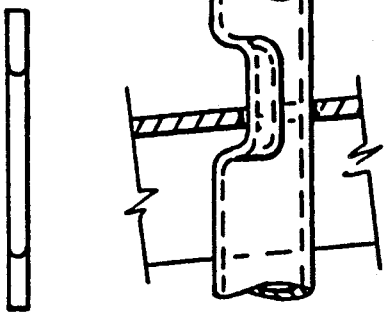
FIG. 5
FIG. 6
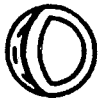
FIG. 7
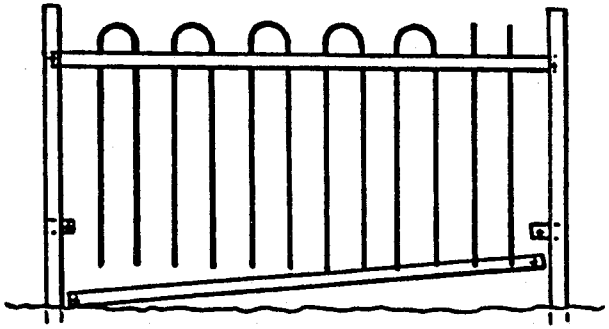
FIG. 10

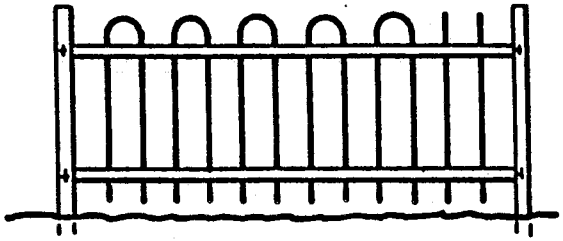
FIG. 11
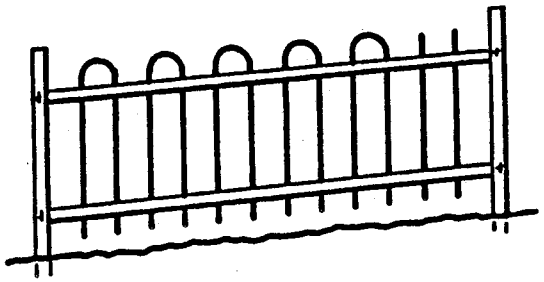
FIG. 12
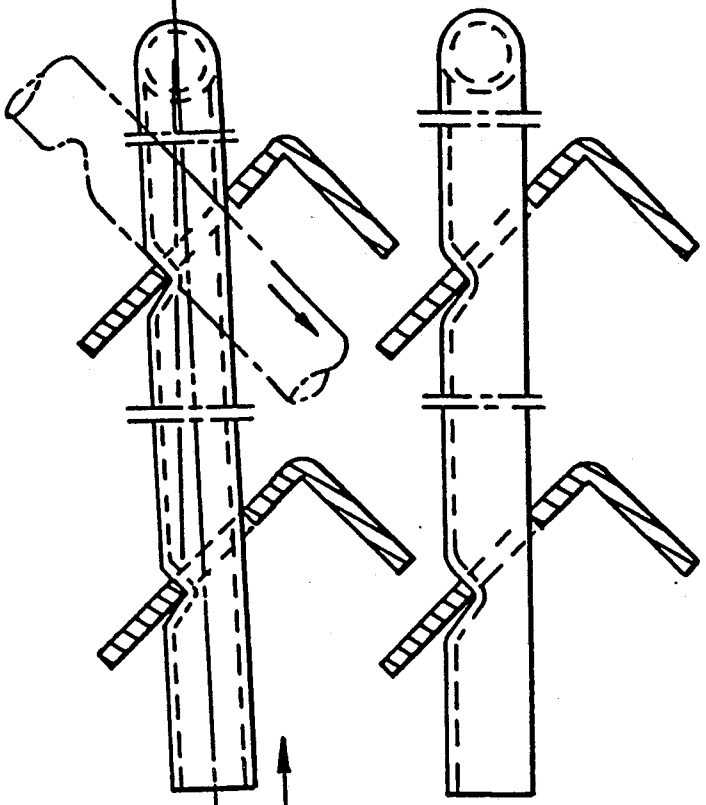
FIG. 9
FIG. 8

FENCE

FIELD OF THE INVENTION

This invention relates to a picket fence.

BACKGROUND OF THE INVENTION

Picket fences have traditionally been made from wood. Whilst wood enables a relatively simply construction to be provided, it has various disadvantageous. Wood is subject to rot. Consequently, after erection of the fence. it has to be painted and then repainted at regular intervals, to keep the fence in good condition. Also, assembly of a wooden fence is time consuming. Usually, the individual picket and horizontal rails have to be cut to length, and then assembled. If a uniform and neat appearence is to be provided, care has to be taken when cutting the pickets and rails. The fence is then assembled using nails or screws, which is relatively time consuming. Such a construction also cannot readily be disassembled, and then reassembled at an alternative location.

Various proposals have been made for forming picket fences and the like from other materials, notably steel and U.K. Pat. No. 29,939 of 1897 (Miller), U.S. Pat. Nos. 30,507 (Stratton), 966,969 (Webb), 2,766,967 (Roberts), 2,919,112 (Cofield), 3,095,184 (Boxberger), 3,212,754 (Revell et al), 3,411,752 (Bos) and applicant's U.S. Pat. No. 4,625,948 disclose fence or like constructions.

The Miller U.K. Pat. No. 29,939 discloses fencing which is capable of accomodating itself to the inclination of the ground on which it is erected and incorporates upper and lower longitudinal, channel section bars which receive a plurality of equidistantly arranged vertical bars of angle iron. The vertical bars are received in the upper and lower longitudinal bars in holes of shapes corresponding to that of the vertical bars and of a size sufficient for the vertical bars to fit loosely therein. The vertical bars are retained in the longitudinal bars by means of tongues produced by piercing the vertical bars. The tongues are located such that they project respectively over the lower longitudinal bar and under the upper longintudinal bar.

The Stratton U.S. Pat. No. 30,507 discloses a picket fence in which vertical pickets are mounted on upper and lower transverse rails by means of pairs of hooks provided on the pickets and adapted for fitting into corresponding notches of the rails. As with the Miller patent discussed above, it is claimed that the disclosed fence contruction admits of the raising or lowering of the ends of the transverse rail to suit varieties of grade.

The Webb U.S. Pat. No. 966,969 relates to a line and corner fence post and bracer that incorporates posts with horizontal braces extending therebetween. Each post includes a plurality of upstruck tongues or clips arranged in pairs and normally utilized for retaining line wires in position, but also for anchoring a longitudinal brace strip. In the main embodiment, however, the brace strips are located in openings formed in flanges of the posts.

The Roberts U.S. Pat. No. 2,766,967 discloses a knock down fence construction, that incorporates horizontal metal straps with tabs punched therein. It also has vertical slats, with notches cut in the edges. These notches correspond to the punch tabs, and the slats are bowed, to enable them to engage the tabs. The construction is intended as a light weight low fence for the edge of flowerbeds and the like.

The Cofield U.S. Pat. No. 2,919,112 discloses a collapsable fence arrangement. For this purpose, horizontal stringers and vertical pickets are rivetted together, to enable relative rotation therebetween.

The Boxberger U.S. Pat. No. 3,095,184 discloses a fence construction to be fabricated almost entirely of sheet metal. Two extruded stringers of stepped channel shape are mounted to extend in horizontal directions and are vertically spaced apart. The stringers include elongated slots for receiving the hook shaped end portions of vertical slats of heavy gauge sheet metal.

The Revell U.S. Pat. No. 3,212,754 discloses an interlocking fence structure. A top rail has specially formed slots and tongues, for engaging vertical pickets. The pickets similarly have a complex cross-section and three projections for securing them in the top rail.

The Bos U.S. Pat. No. 3,411,752 discloses a guardrail construction, such as a balcony balustrade. Here, generally I-section vertical members are provided. These members are accomodated in corresponding openings of top and bottom horizontal rails. Pins secure the vertical members in the horizontal rails. To cover the tops of the vertical members protruding through the top horizontal rail a sheet form handrail is provided.

Applicant's U.S. Pat. No. 4,625,948 discloses a picket fence construction having transverse rails and a plurality of pickets adaped to be mounted in the rails. The pickets are hung by means of a tongue and engaging link arrangement. The rail includes a tongue for each picket, and each picket includes an engaging link, or alternatively the tongues and links are reversed.

SUMMARY OF THE INVENTION

According to a first aspect of the present invention there is provided a fence construction comprising a first rail provided with a plurality of mounting locations for mounting a plurality of pickets to the rail. A mounting location is provided for each picket and has vertically and horizontally spaced opposing first and second surfaces, each picket being provided with corresponding oppositely directed first and second surfaces. The downwardly directed first surface is adapted for engaging the respective first surface of a first mounting location and the second surface is adapted for engaging the respective second surface of the first mounting location. The diameter of each picket is less than the spacing of the respective first and second surfaces of the first mounting location to allow an inclined picket to pass therebetween and thus permit the picket to be located on the rail. Retaining means are also provided for retaining the pickets on the rail in a substantially upright orientation and retaining the respective first and second surfaces of each picket in engagement with the first and second surfaces of the first mounting location.

Preferably, each first mounting location of the first rail is provided with a downwardly directed third surface and each picket has a corresponding upwardly directed surface for engaging a respective third surface of the rail to prevent withdrawal of the upright picket from the rail.

In a preferred embodiment, the first rail includes an inclined member and the first mounting locations are in the form of circular apertures in the inclined member. The pickets may also be of circular cross section and are of slightly smaller diameter than the apertures, the downwardly directed first surfaces and the upwardly directed third surface of each picket being provided at a recess formed on one side of the picket and the second surface being formed on the opposite side of the picket.

The retaining means are preferably in the form of a second rail which may be provided with a mounting location, similar to the mounting location of the first rail for engaging corresponding surfaces of the picket.

In a further aspect of the present invention each picket has first and second attached arms. In addition to the first mounting locations, the first rail is further provided with a plurality of second mounting locations, one for the second arm of each picket. The configuration of the first arms of the pickets permit at least some degree of rotation between the rail and the first arms and the configuration of the second arms of the pickets permit at least some vertical movement between the rail and the second arms, permitting the rail to be inclined while the pickets are maintained in a substantially upright configuration. Thus this aspect of the invention permits a fence to be constructed on an inclined surface while the pickets are maintained in an upright orientation.

According to a still further aspect of the present invention is provided a fence construction comprising first and second rails and a plurality of resilient pickets, each picket having first and second attached arms for mounting on the rails. The arms of each picket are biased to assume a first confirguration, and at least one of the rails is arranged to retain the arms in a second configuration. The resulting tension in each of the pickets tends to locate the pickets securely relative to the rails.

BRIEF DESCRIPTION OF THE DRAWINGS

These and other aspects of the invention will now be described, by way of example, with reference to the accompanying drawings, in which.

DETAILED DESCRIPTION OF PREFERRED EMBODIMENTS

Figure 1:
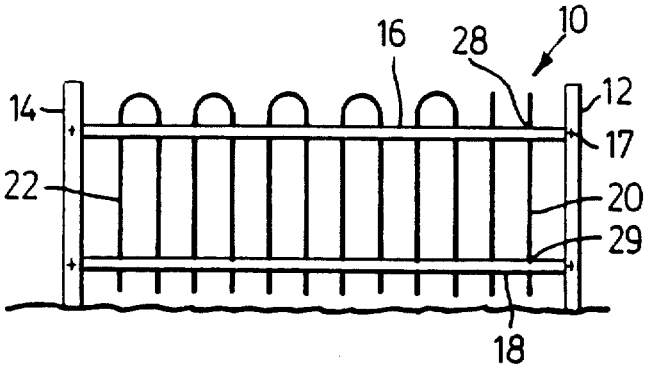
FIG. 1 shows a fence construction according to a preferred embodiment of the present invention.

Reference is first made to FIG. 1 of the drawings which illustrates a fence construction in accordance with a first preferred embodiment of the present invention. The fence construction, generally indicated as 10, is mounted between two upright posts 12, 14 and comprises first and second vertically spaced rails 16, 18 and a plurality of pickets 20, 22. Two forms of pickets are illustrated in FIG. 1: two simple rod-like pickets 20; and five inverted U-shaped pickets 22.

The posts 12, 14 do not form part of the invention and simply serve as supports for the rails 16, 18. Their function could be performed equally well by posts or support of some other form.

Figure 2:
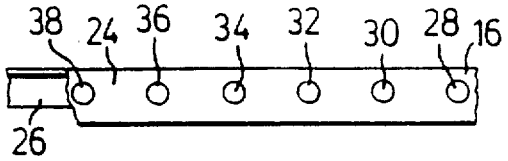
FIG. 2 is a view from above and from the front of a rail of the fence construction of FIG. 1.

The rails 16, 18 extend between the posts 12, 14 and are secured thereto by means of any suitable fastening 17. Referring now also to FIG. 2 of the drawings, the rails 16, 18 are formed of lengths of angle iron, each comprising an inclined front member 24, 25 and a shorter inclined rear member 26, 27, perhaps best illustrated in FIG. 6 of the drawings.

Each front member 24, 25 includes a plurality of circular holes providing mounting locations for the pickets. The two holes 28, 30 to the right of FIG. 2 are for mounting the rod-like pickets 20, while the two remaining pairs of holes 32, 34 and 36, 38 are for mounting the inverted U-shaped pickets 22.

Figure 3:
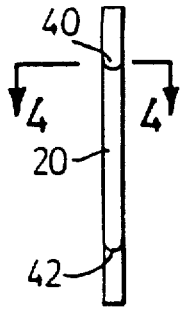
FIG. 3 is a view of a first form of picket of the fence construction of FIG. 1.
Figure 4:
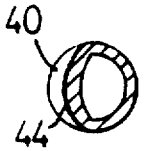
FIG. 4 is a sectional view on line 4—4 of FIG. 3.

A rod-like picket 20 is illustrated in FIGS. 3, which shows the first and second mounting locations in the forms of recesses 40, 42 provided on the picket 20 for engaging corresponding mounting locations or holes 28, 29 of the respective rails 16, 18. If reference is made to FIG. 4 of the drawings it will be noted that the picket 20, formed of sheet tube, has a circular cross section. The recesses 40, 42 are formed by pressing the tube to form an area of reduced cross section and to form an elliptical surface 44.

Figure 5:
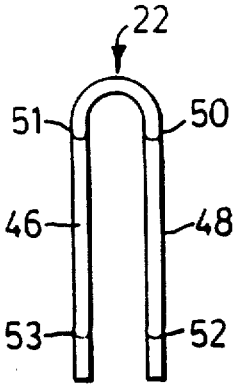
FIG. 5 is a view of a second form of picket of the fence construction of FIG. 1.

FIG. 5 illustrates a second form of picket 22 shaped as an inverted U and having first and second attached arms 46, 48. The picket 22 is, in effect, similar to two rod-like pickets 20 joined together, and each arm is provided with a respective first mounting location or recess 50, 51 providing respective first, second and third surfaces and a lower second mounting location or recess 52, 53, providing corresponding respective fourth, fifth and sixth surfaces.

Figure 6:
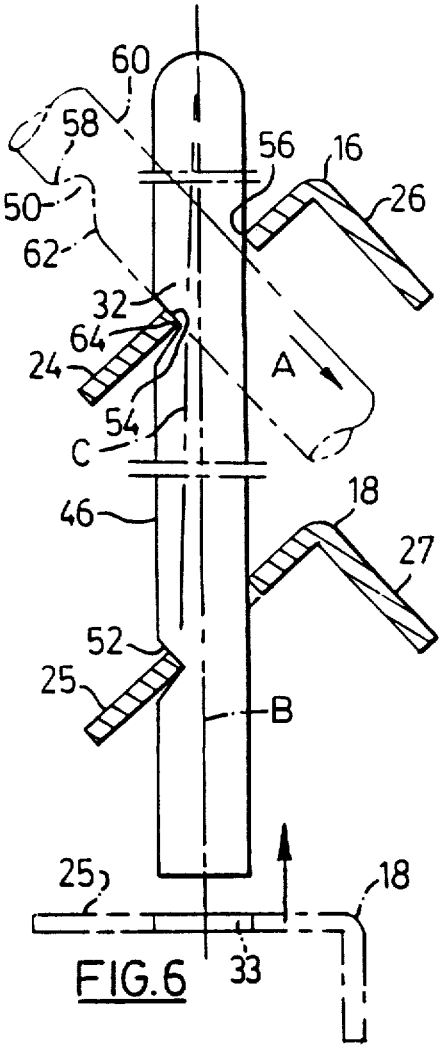
FIGS. 6 and 7 illustrate stages in the assembly of the fence construction of FIG. 1.
Figure 7:
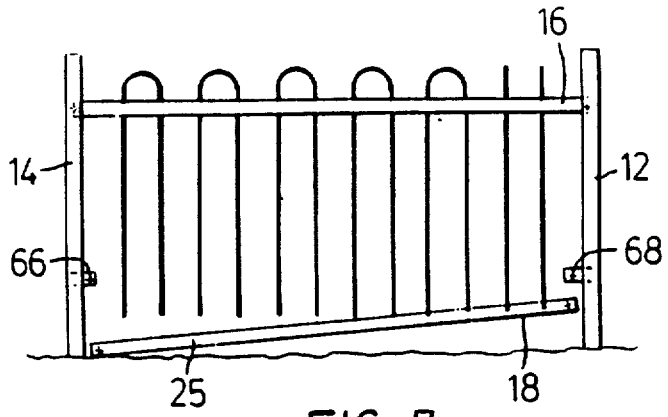

The interaction between the holes in the rails 16, 18 with the recess of the pickets 20, 22 will now be described with reference to FIGS. 6 and 7 which illustrate various stages in the assembly of a fence. FIG. 6 shows the first arm 46 of picket 22 mounted on the first and second rails 16, 18. The diameter of the arm 46 is slightly less than the diameter of the hole 32, preferably to provide a clearance of approximately 1/16", such that the picket 22 may be inclined and passed through the hole 32 in the direction shown by arrow A, as is illustrated in chain-dotted outline in FIG. 6. The arm 46 is passed through the hole 32 until the recess 50 is adjacent the lower edge of the hole. At this point, the picket 22 is rotated to a substantially upright orientation in which the recess 50 in the picket 22 co-operates with the hole edges to retain the picket on the rail 16. Functionally, the hole edge provides first and second opposing surfaces 54, 56 for engaging corresponding oppositely directed first and second surfaces 58, 60 of the arm 46. The surfaces 54, 56, are spaced generally transversely to the rail 16. The first surface 58 of the arm 46 is provided by the downwardly directed portion of the recess, while the second surface 60 is provided by the rear wall of the arm. The lower portion of the recess provides a third surface 62 for engaging a corresponding third surface 64 formed on the underside of the member 24 adjacent the hole, in the event of an attempt being made to pull the arm 46 upwards while upright. As the diameter of the arm is greater than the horizontal spacing of the first and second surfaces 58, 60 of the wall the picket cannot be moved from the hole, at least while in a vertical orientation.

In practice, it has been found that the fence may be assembled most easily if all of the pickets are first mounted on the first rail 16. A second rail 18 is then located on the lower portions of the pickets by inclining the rail 18 such that the first member 25 lies horizontally, as illustrated in chain-dotted outline in FIG. 6, and passing the rail 18 over the arm 46 of the picket until adjacent the lower recess 52. The rail is then rotated through approximately 45° such that the edges of the hole 33 engage the recess 52 and the rear wall of the arm in a similar manner to the upper hole 32 and first recess 50. It has been found that the initial mounting of the rail 18 on the picket is carried out more easily if the rail 18 is first located over the ends of the pickets 20, 22 one at a time, as shown in progress in FIG. 7. Once the pickets 20, 22 are positioned in the respective holes, the rail 18 is lifted to adjacent the recesses and then rotated as described above. The rail 18 is then attached to brackets 66, 68 extending from the posts 12, 14 using suitable fastening means.

Figure 8:
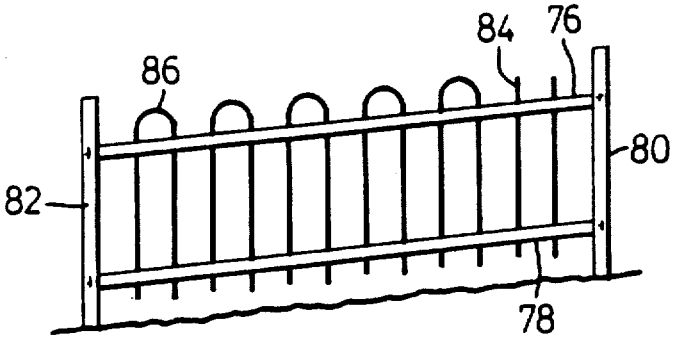
FIG. 8 shows a fence construction of a further preferred embodiment of the present invention.

The embodiments of the inventions described above are primarily intended for building fences on substantially level ground. However, fences must often be located on inclines. A further preferred embodiment of the present invention is specially adapted for inclined sites and will now be described with reference to FIGS. 8 and 9. A fully assembled fence is shown in FIG. 8, and it will be noted that the appearance of the fence is similar to the fence described above and as shown in FIG. 1, apart from the inclination of the rails 76, 78. The support posts 80, 82 and the pickets 84, 86 remain substantially upright.

The construction of a fence consisting solely of rod-like pickets 84 may be achieved using the same apparatus as was described with reference to FIG. 1. The clearance between the mounting locations of the rails 76, 78 and the pickets 84, more particularly the picket mounting location of recesses, allows a degree of relative rotation therebetween, sufficient to permit assembly of fences on an incline such as illustrated in FIG. 8.

Such a degree of movement between a rail and a picket is not, however, possible with the inverted U-shaped pickets 22 described above. It is evident that to accomodate an inclination of the rails 76, 78 such as is illustrated in FIG. 8, that in addition to rotation between the respective mounting location of the pickets 86 and the rails 76, 78 at least one of the arms of the picket 86 must be capable of moving vertically with respect to the respective transverse rail. This movement cannot be accomodated by the picket 22 described above. Accordingly, each picket 86 is provided with mounting locations intended to accomodate this movement.

Figure 9:
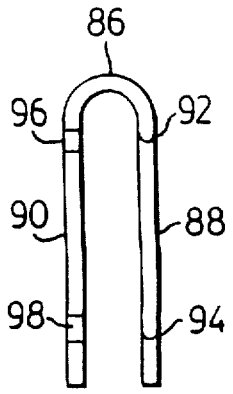
FIG. 9, shows a form of picket of the fence construction of FIG. 8.
Figure 10:
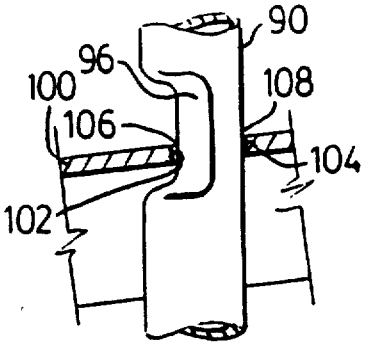
FIG. 10 shows, partly in section, a stage in the assembly of the fence construction of FIG. 8.

FIG. 9 shows a picket 86 having first and second arms 88, 90. Conventional first and second mounting locations or recess 92, 94 are provided on the first arm 88 in a similar manner to the picket 22. However the second arm 90 is provided with rectangular first and second mounting locations or recesses 96, 98, one of which is illustrated in more detail in FIG. 10 of the drawings. The portion of the second arm 90 illustrated in FIG. 10 is shown in the process of being located in a first member 100 of the first transverse rail 76. Expressed functionally, the interation between the arm 90 and the hole edges involves engagement between opposing first and second surfaces 102, 104 provided by the holes edges and parallel and oppositely directed first and second surfaces 106, 108 of the arm 90. The first surface 106 is located on the front of the arm 90, in the recess, while the second surface 108 is formed by the rear wall of the arm.

The angle of inclination which may be accomodated by the rail 76, 78 and pickets 86, is limited by the range of rotation possible between the recesses 92, 94 of the first arm 88 and the rails 76, 78 and the height of the recesses 96, 98 (or the distance between the longitudinally spaced stops which define the upper and lower boundaries of the recesses) in the second arms 90, together with the clearance between the arms 88, 90 and the hole edges.

The method of assembly of the fence shown in FIG. 8, is substantially similar to that of the fence illustrated in FIG. 1.

Figure 11:
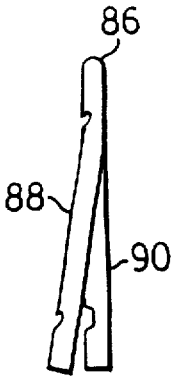
FIG. 11 is a side view of the picket of FIG. 9.

Reference is now made to FIG. 11 of the drawings which shows a side view of the picket 86, and illustrates a preferred feature of the inverted U-shaped pickets. The unrestrained picket 86 assumes a first configuration in which the second arm 90 is substantially upright, while the first arm is inclined.

When a fence is assembled using the pickets 86, mounting the pickets 86 on the rails 76, 78 forces the arms 88, 90 to assume a second configuration in which the arms are substantially aligned. Reference is made briefly to FIG. 6 of the drawings, where line B illustrates the axis of a typical unrestrained first arm, while line C is the axis of the same arm in an assembled fence. This elastic deformation of the picket results in an elastic tension between the arm and causes them to tightly engage the restraining surfaces of the respective holes in the rail and as a result of this, fences assembled using such pickets are substantially "rattle free".

From the above description it may be seen that the various aspects of the present invention provided a fence construction which involves relatively few parts and a minimal number of fastening means. The configuration of the pickets and rails are also adapted for easy disassembly of the parts.

Those skilled in the art will realize the various modifications and improvements may be made to the examples of the invention described above, without departing from the scope and spirit of the invention. The rails and pickets are primarily intended to be manufactured of steel, in the form of angle iron, though other suitable materials may be used. Further, rails of forms other than the angle iron described above may be used to provide suitable mounting locations.

We claim:

1. A fence construction comprising:

a first rail having a longitudinal axis and including a first member extending at an incline from and parallel to said longitudinal axis and provided with a plurality of longitudinally spaced first mounting locations, each mounting location having opposing vertically spaced first and second surfaces, the surfaces further being spaced generally transversely relative to said longitudinal axis;

a plurality of pickets for mounting to the first rail each picket provided with oppositely directed first and second surfaces, the first surface for engaging the respective first surface of the first mounting location on the first rail and the second surface for engaging the respective second surface of the first mounting location, the diameter of each picket being lesser than the spacing of the respective first and second surfaces of the first mounting location of the first rail to allow a picket, which is inclined and in a plane substantially perpendicular to said longitudinal axis to pass therebetween; and retaining means for retaining the pickets in a substantially upright orientation and retaining the respective first and second surfaces of each picket in engagement with the first and second surfaces of the first mounting location of the first rail.

2. The fence construction of claim 1, wherein the first surfaces of the mounting locations are downwardly directed.

3. The fence construction of claim 2 wherein each first mounting location of the first rail is provided with a third surface and each picket has an upwardly directed third surface for engaging a respective third surface of the rail to prevent withdrawal of the upright picket from said rail.

4. The fence construction of claim 3 wherein the first and third surfaces of each first mounting location are disposed adjacent one another and the first and third surfaces of each picket are disposed adjacent one another.

5. The fence construction of claim 4 wherein the first and third surfaces of each mounting location are vertically disposed relative to one another and the first and third surfaces of each picket are vertically disposed relative to one another.

6. The fence construction of claim 3 wherein the first and third surfaces of each picket are provided at a recess in the picket.

7. The fence construction of claim 1 wherein the first surface of each picket is provided at a recess in the picket.

8. The fence construction of claim 1 wherein each mounting location is in the form of an aperture in the inclined member and the first surface of each mounting location of the first rail is located below the respective second surface.

9. The fence construction of claim 8 wherein the apertures in the first inclind member and the respective pickets are of corresponding shape.

10. The fence construction of claim 9 wherein the apertures in the first inclined member are circular.

11. The fence construction of claim 9 wherein the rail comprises said first inclined member and a second inclined member, said members being joined at an apex which extends parallel to said longitudinal axis above the apertures in the first inclined member.

12. The fence construction of claim 1 wherein the retaining means is in the form of second transverse rail.

13. The fence construction of claim 12 wherein the second rail has a respective longitudinal axis and a first member extending at an incline from and parallel to said longitudinal axis provided with a plurality of first mounting locations, one for each picket, each mounting location having vertically spaced opposing first and second surfaces, the spaces further being spaced generally transversely relative to said longitudinal axis, each picket having a first surface for engaging the respective first surface of the first mounting location of the second rail and the second surface for engaging the respective second surface of the first mounting location, the diameter of each picket being lesser than the direct spacing of the respective first and second surfaces of the first mounting location of the second rail to allow a picket, which is inclined relative to the rail and aligned with a plane substantially perpendicular to said longitudinal axis, to pass therebetween.

14. The fence construction of claim 1 wherein each picket is in the form of a rod.

15. The fence construction of claim 1 wherein each picket has first and second attached arms, the first and second surfaces of each picket provided on the first arm of the picket for co-operating with the respective first mounting location of the first rail.

16. The fence construction of claim 15 wherein further surfaces are provided on the second arm of each picket for co-operating with the respective second mounting location on the first rail.

17. The fence construction of claim 16 wherein each second mounting location of the first rail at least restrains the second arm of the picket from lateral movement and limits rotation of the respective first arm.

18. The fence construction of claim 17 wherein each second mounting location of the first rail permits limited relative vertical movement between the first rail and the respective second arm of each picket wherein the first rail may be inclined while the pickets remain substantially upright.

19. The fence construction of claim 15 wherein the arms of each picket are biassed to assume a non-parallel configuration and the retaining means are arranged to retain the arms of each picket in a substantially parallel orientation, the resulting tension created in the picket tending to firmly locate the picket relative to the retaining means.

20. A method of constructing a fence between two mounting locations comprising:

providing a first rail having a longitudinal axis and a first inclined member provided with a plurality of first mounting locations each having vertically and horizontally spaced opposing first and second surfaces spaced generally transversely relative to said longitudinal axis, then;

mounting the first rail to extend between the mounting locations, then;

providing a plurality of pickets, each provided with oppositely directed first and second surfaces, the diameter of each picket being less than the spacing of the respective first and second surfaces of the first mounting location of the first rail, then;

inclining the pickets and aligning the pickets with a plane substantially perpendicular to said longitudinal axis and passing the pickets between respective first and second surfaces of the first mounting location of the first rail until the first and second surfaces of each picket are adjacent the respective first and second surfaces of a first mounting location, then;

rotating the pickets to a substantially upright orientation to bring the first and second surfaces of each picket into engagement with the respective first and second surfaces of the first mounting locations of the first rail, then;

providing a second rail provided with means for engaging the pickets, then;

engaging the pickets with the second rail, and then;

mounting the second rail to extend between the posts wherein the second rail has a longitudinal axis and includes a first member extending at an incline from and parallel to said longitudinal axis and provided with a plurality of first mounting locations each having vertically spaced opposing first and second surfaces, the surfaces further being spaced generally transversely relative to said longitudinal axis, and each picket is provided with oppositely direct third and fourth surfaces, the diameter of each picket being less than the direct spacing of the respective first and second surfaces of the first mounting location of the second rail and to engage the pickets with the second rail the first inclined member of the second rail is first inclined substantially perpendicularly to the pickets and the pickets passed between the respective first and second surfaces of the second rail until the respective third and fourth surfaces of each picket are adjacent the first and second surfaces at a first mounting location of the second rail and then rotating the second rail to bring the third and fourth surfaces of each picket into engagement with the respective first and second surfaces of the first mounting location of the second rail.

* * * * *

UNITED STATES PATENT AND TRADEMARK OFFICE

CERTIFICATE OF CORRECTION

PATENT NO. : 5,002,260

DATED : March 26, 1991

INVENTOR(S) : Kaljo Lustvee

It is certified that error appears in the above-identified patent and that said Letters Patent is hereby corrected as shown below:

Title Page

The title page showing the illustrative figure should be deleted and substituted therefore the attached title page.

Sheets 1 and 2 of the drawings consisting of Figs. 1-12, should be deleted to be replaced with the sheets of drawings, consisting of Figs. 1-11, as shown on the attached page.

Signed and Sealed this

Twenty-first Day of January, 1992

*Attest:*

HARRY F. MANBECK, JR.

*Attesting Officer*

*Commissioner of Patents and Trademarks*

United States Patent [19]

Lustvee

[11] Patent Number: 5,002,260

[45] Date of Patent: Mar. 26, 1991

[54] FENCE

[76] Inventor: Kaljo Lustvee, 18 Finchley Road, Islington, Ontario, Canada, M9A 2X5

[21] Appl. No.: 389,089

[22] Filed: Aug. 3, 1989

[51] Int. Cl.[5] ..... E04H 17/14

[52] U.S. Cl. ..... 256/22; 256/59; 256/65; 256/70; 256/72

[58] Field of Search ..... 256/65, 59, 70, 22, 256/72

[56] References Cited

U.S. PATENT DOCUMENTS

| | | | |
|---|---|---|---|
| 262,879 | 8/1882 | Woodhill | 256/72 |
| 292,023 | 1/1884 | Manlove | 256/65 |
| 448,029 | 3/1891 | Hanika | 256/65 |
| 485,268 | 11/1892 | Flynn | 256/72 |
| 502,840 | 8/1893 | Ward | 256/65 |
| 743,046 | 11/1903 | Stewart et al. | 256/72 |
| 1,611,737 | 12/1926 | Coruss | 256/72 |
| 1,757,686 | 5/1930 | Rosenbaum | 256/72 X |
| 2,976,021 | 3/1961 | Stefan | 256/65 |
| 3,286,850 | 11/1966 | Ruhnke | 256/65 X |
| 3,700,213 | 10/1972 | Blease | 256/59 X |

*Primary Examiner*—Randolph A. Reese
*Assistant Examiner*—Carol I. Bordas
*Attorney, Agent, or Firm*—Rogers, Bereskin & Parr

[57] ABSTRACT

A fence construction includes a first transverse rail having a plurality of first mounting locations, each for mounting one of a plurality of pickets. Each mounting location of the rail has vertically and horizontally spaced opposing first and second surfaces, and each picket is provided with corresponding oppositely directed first and second surfaces, an downwardly directed first surface for engaging a respective first surface of a mounting location and a second surface for engaging a respective second surface of the mounting location. The diameter of each picket is selected to be less than the spacing of the respective first and second surfaces of the mounting location to allow an inclined picket to pass therebetween and thus be located on the rail. A second transverse rail is provided for retaining the pickets in a substantially upright orientation and for retaining the first and second surfaces of each picket in engagement with the respective first and second surfaces of the mounting location.

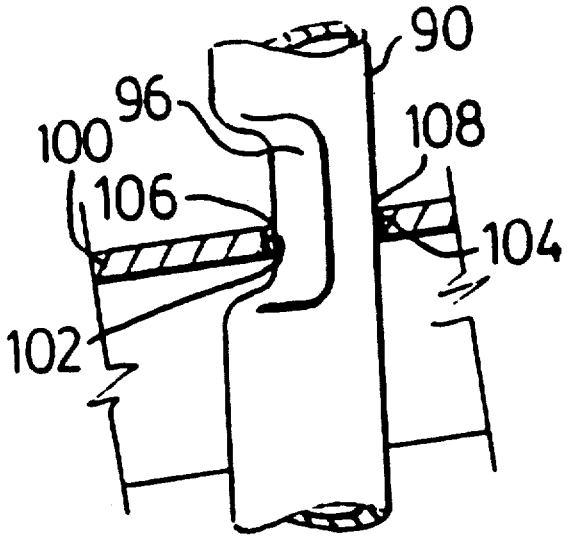

20 Claims, 2 Drawing Sheets